US010597840B2

(12) United States Patent
Zhou et al.

(10) Patent No.: US 10,597,840 B2
(45) Date of Patent: Mar. 24, 2020

(54) HOT-MELT ANCHOR HEAD

(71) Applicant: SUZHOU NG. FOUNDATION ENGINEERING CO., LTD., Suzhou, Jiangsu (CN)

(72) Inventors: Jianming Zhou, Suzhou (CN); Huiju Fan, Suzhou (CN); Mingxiang Du, Suzhou (CN); Xiaoming Lu, Suzhou (CN)

(73) Assignee: SUZHOU NG. FOUNDATION ENGINEERING CO., LTD., Jiangsu (CN)

( * ) Notice: Subject to any disclaimer, the term of this patent is extended or adjusted under 35 U.S.C. 154(b) by 0 days.

(21) Appl. No.: 16/461,014

(22) PCT Filed: May 31, 2017

(86) PCT No.: PCT/CN2017/086577

§ 371 (c)(1),
(2) Date: May 15, 2019

(87) PCT Pub. No.: WO2018/090599

PCT Pub. Date: May 24, 2018

(65) Prior Publication Data

US 2019/0301125 A1 Oct. 3, 2019

(30) Foreign Application Priority Data

Nov. 18, 2016 (CN) ..... 2016 1 1016515
Dec. 16, 2016 (CN) ..... 2016 1 1163994

(51) Int. Cl.
*E02D 5/80* (2006.01)
*E02D 5/74* (2006.01)

(52) U.S. Cl.
CPC ..... *E02D 5/80* (2013.01); *E02D 5/74* (2013.01); *E02D 2220/00* (2013.01)

(58) Field of Classification Search
CPC ..... E02D 5/74; E02D 2220/00; E02D 5/80; E02D 2600/10
See application file for complete search history.

(56) References Cited

U.S. PATENT DOCUMENTS 4,934,873 A * 6/1990 Calandra, Jr. ..... E21D 11/006 405/259.1
5,707,181 A * 1/1998 von Allmen ..... C21D 1/42 405/262

(Continued)

FOREIGN PATENT DOCUMENTS

CH 667681 * 10/1988
CN 103132518 * 6/2013

(Continued)

*Primary Examiner* — Carib A Oquendo
(74) *Attorney, Agent, or Firm* — Oliff PLC

(57) ABSTRACT

A hot-melt anchor head which belongs to technical field of fixed-foundation buildings. Hot-melt anchor head includes anchor ring provided with through hole, guide wire, electrical hot-melt member arranged on anchor ring, clamp piece arranged in through hole to clamp anchor cable reinforcement, and strain gauge connected to guide wire arranged on surface of anchor ring, wherein bottom of anchor ring is provided with bearing plate; which is provided with opening opposite to through hole, and anchor ring is made of metal material; and surface of anchor ring is formed with coating layer by injection moulding with hot-melt material, strain gauge is coated by coating layer and is in close contact with surface of anchor ring to be integrally formed, an end, close to bearing plate, of anchor ring extends inwards and is provided with flange, and flange is used for holding part, located inside through hole, of coating layer.

16 Claims, 2 Drawing Sheets

(56) References Cited

U.S. PATENT DOCUMENTS

| | | | | |
|---|---|---|---|---|
| 9,657,453 | B1 * | 5/2017 | Shin | E02D 5/765 |
| 2018/0002885 | A1 * | 1/2018 | Sun | F24S 25/617 |
| 2019/0017241 | A1 * | 1/2019 | Kim | G01B 5/30 |

FOREIGN PATENT DOCUMENTS

| | | | |
|---|---|---|---|
| CN | 103898903 | * | 7/2014 |
| CN | 106703030 | * | 5/2017 |
| CN | 206298898 | * | 7/2017 |
| CN | 207003254 | * | 2/2018 |

* cited by examiner

HOT-MELT ANCHOR HEAD

BACKGROUND OF THE INVENTION

1. Technical Field

The invention relates to an anchor head, and belongs to the technical field of fixed-foundation buildings.

2. Description of Related Art

With the advance of urbanization, foundation pit support and slope support are needed for construction of underground facilities, such as an underground parking, an underground walkway, an underground business street and an underground railroad.

Chinese Invention Patent Application number CN201310086728.6, applied by an applicant, discloses an improved clamp piece type anchor device comprising an anchor stock, wherein the anchor stock has a core capable of being conveniently disassembled and recovered without affecting the supporting performance during foundation pit support and slope support. However, the anchor stock does not have an accurate and real-time force measurement function.

As known by the applicant, the anchor stock in the prior art ordinarily measures a force through a strain gauge; however, due to the fact that an existing strain gauge is generally fixed in an anchor cable or an anchor cable bearing plate by direct adhesion, the strain is likely to fall under the actual complicated and changeable construction conditions, and measurement results are inaccurate.

BRIEF SUMMARY OF THE INVENTION

Aiming at the defects of the prior art, the technical issue to be settled by the invention is to provide a hot-melt anchor head which is simple in structure, accurate in force measurement and capable of realizing the recovery of an anchor cable reinforcement.

The technical scheme provided by the invention to settle the above technical issue is as follows: a hot-melt anchor head includes an anchor ring, a guide wire, an electrical hot-melt member and a clamp piece, wherein the anchor ring is provided with at least one through hole, the guide wire can be electrified, the electrical hot-melt member is arranged on the anchor ring and connected with the wire, and the clamp piece arranged in the through hole to clamp an anchor cable reinforcement; and the bottom of the anchor ring is provided with a bearing plate; the bearing plate is provided with an opening opposite to the through hole, and the anchor ring is made of a metal material. The hot-melt anchor head further comprises a strain gauge connected with the guide wire and arranged on the surface of the anchor ring, wherein the surface of the anchor ring is formed with a coating layer by injection moulding with a hot-melt material, the strain gauge is coated by the coating layer and is in close contact with the surface of the anchor ring so as to be integrally formed, an end, close to the bearing plate, of the anchor ring extends inwards and is provided with a flange, and the flange is used for holding a part, located inside the through hole, of the coating layer. When the hot-melt anchor head clamps the anchor cable reinforcement, the part, located inside the through hole, of the coating layer fills a space between the anchor ring and the clamp piece and is limited in the space in all directions; and when the part, located inside the through hole, of the coating layer is heated to be melted by the electrical hot-melt member, the hot-melt anchor head releases the anchor cable reinforcement.

The technical scheme of the hot-melt anchor head disclosed by the invention has the following working principle and beneficial effects:

The clamp piece is arranged in the through hole and clamps the anchor cable reinforcement (a steel strand); as the part, located inside the through hole, of the coating layer fills the space between the anchor ring and the clamp piece and is limited in the space in all directions (the clamp piece internally limits the part, located inside the through hole, of the coating layer, the bearing plate externally limits the part, located inside the through hole, of the coating layer, the anchor ring peripherally surrounds the part, located inside the through hole, of the coating layer, and in this way, the part, located inside the through hole, of the coating layer is completely limited in all directions of the space), when the clamp piece is inserted into the through hole, the part, located inside the through hole, of the coating layer is effectively clamped in the through hole by the anchor ring, the clamp piece and the bearing plate, at this moment, the part, located inside the through hole, of the coating layer is in a solid state, and a confining pressure effect can be formed on the part, located inside the through hole, of the coating layer, namely a pressed object has compressive strength improved by several times, dozens of times or even hundreds of times when limited in all directions in a space without being deformed, in this way, the clamp piece is reversely pressed by the part, located inside the through hole, of the coating layer to clamp the anchor cable reinforcement so as to bear a great drawing force, and existing supporting requirements can be completely met.

When a core material needs to be withdrawn, the guide wire is electrified to heat the electrical hot-melt member, and the part, located inside the through hole, of the coating layer can be softened or melted and then flows out of the bearing plate and the anchor ring, in this way, the confining pressure effect on the part, located inside the through hole, of the coating layer is relieved, and the frictional resistance between the core material and the clamp piece is reduced or relieved, and the purpose of conveniently withdrawing the core material is achieved.

During measurement, because the strain gauge is wrapped by the coating layer and is in close contact with the surface of the anchor ring so as to be integrally formed, the steel strand, namely the internal force of an anchor stock, can be accurately monitored in real time.

In addition, as the surface of the anchor ring is integrally formed with the coating layer by injection moulding with the hot-melt material, the strain gauge is in close contact with the anchor ring so as to be integrally formed and be firmly fixed, so that the hidden danger that the strain gauge falls under complicated and changeable construction conditions and complicated and changeable transportation conditions is prevented during actual construction and transportation; and meanwhile, a complete protective layer is integrally formed by injection moulding on the whole surface of the metal anchor ring, so that the structure is simple, force measurement is accurate, and corrosion prevention of the whole anchor head, filling limitations required when clamping is conducted in the through hole of the anchor head and filling hot-melting required when release is conducted in the through hole of the anchor head are achieved at the same time.

The improvement of the above technical scheme is as follows: the hot-melt anchor head is also provided with a measuring terminal used for measuring the length of the anchor cable reinforcement, and the measuring terminal communicates with the outside through the guide wire or through a wireless signal.

The above technical scheme adopted by the invention has the following advantage: as the hot-melt anchor head is provided with the measuring terminal used for measuring the length of the anchor cable reinforcement, the actual length of an anchor cable can be reliably measured in real time, and this is very important for engineering construction.

One of the advantages of the above technical scheme is as follows: the strain gauge has a heat insulation property.

The above technical scheme adopted by the invention has the following advantages: because a common strain gauge will become ineffective at a temperature over 100'C, the surface of the anchor ring is integrally formed with the coating layer by injection moulding with the hot-melt material, generally, the temperature during injection moulding is over 300° C., and in order to better implement the invention, the strain gauge with the heat insulation property should be adopted.

The improvement of one of the advantages of the above technical scheme is as follows: the strain gauge is attached to the inner wall of the through hole of the anchor ring, and a hole allowing the guide wire to penetrate through is formed in the side wall of the anchor ring;

During measurement, because the strain gauze is attached to the inner wall of the through hole of the anchor ring, a confining pressure structure formed on a hot-melt layer inside the through hole is realized in the anchor ring, a drawing force applied on the anchor cable can be completely transferred into the hot-melt layer inside the through hole through the clamp piece and be reliably transferred to the strain gauge from the hot-melt layer inside the through hole, and accordingly, the steel strand, namely the internal force of an anchor stock, can be accurately monitored in real time.

The improvement of one of the advantages of the above technical scheme is as follows: the strain gauge is attached to the outer side wall of the anchor ring, the upper end surface of the anchor ring or the lower end surface of the anchor ring.

One of the advantages of the above technical scheme is as follows: the electrical hot-melt member is arranged in the through hole and is tightly wrapped by the part, located inside the through hole, of the coating layer so as to be integrally formed.

One of the advantages of the above technical scheme is as follows: the electrical hot-melt member is arranged on the outer side wall of the anchor ring and is in close contact with the outer side wall of the anchor ring and the part, located outside the through hole, of the coating layer so as to be integrally formed.

One of the advantages of the above technical scheme is as follows: the part, located outside the through hole, of the coating layer is used for protecting the anchor ring.

One of the advantages of the above technical scheme is as follows: the part, located inside the through hole, of the coating layer has a conical surface matched with the clamp piece.

BRIEF DESCRIPTION OF THE SEVERAL VIEWS OF THE DRAWINGS

The invention is further detailed as follows in combination with the drawings.

DETAILED DESCRIPTION OF THE INVENTION

Embodiment

Figure 1:
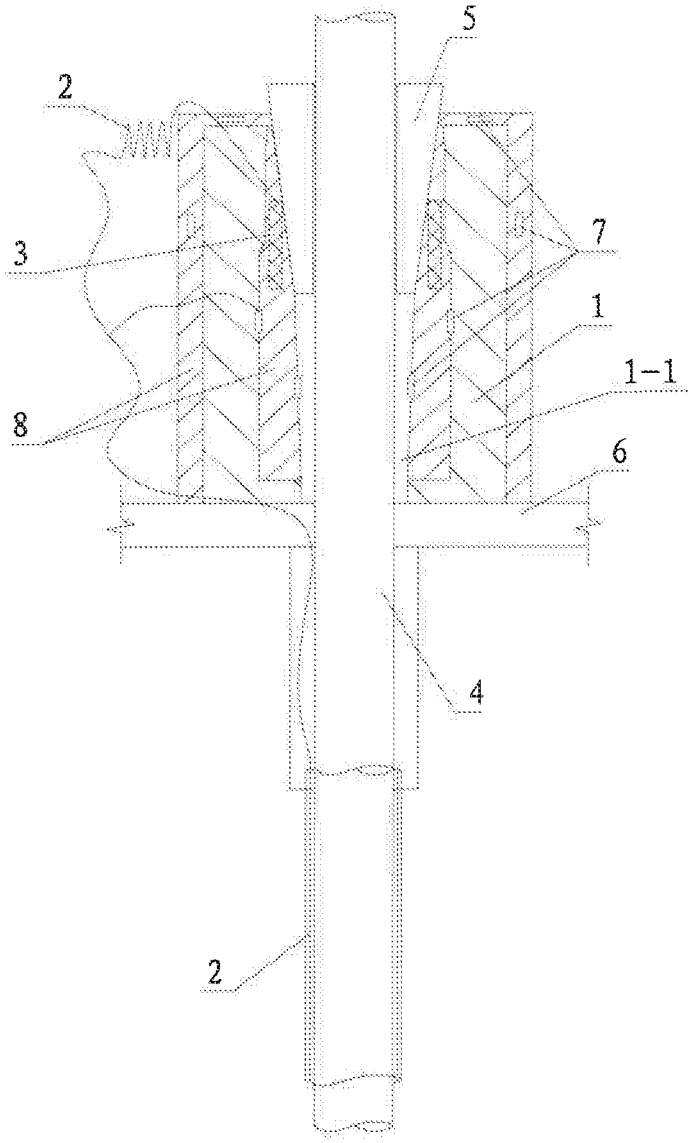
FIG. 1 is structural view 1 of a hot-melt anchor head of the embodiment of the invention.
Figure 2:
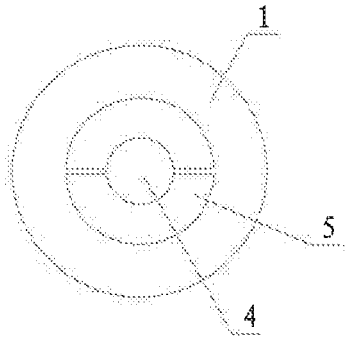
FIG. 2 is a top view of FIG. 1.

As shown in FIG. 1 and FIG. 2, in this embodiment, the hot-melt anchor head includes an anchor ring 1, a guide wire 2, an electrical hot-melt member 3 and a clamp piece 5, wherein the anchor ring 1 is provided with at least one through hole 1-1; the guide wire 2 can be electrified; the electrical hot-melt member 3 is arranged on the anchor ring 1 and connected with the guide wire 2; the clamp piece 5 is arranged in the through hole 1-1 to clamp an anchor cable reinforcement 4; and a bearing plate 6 is arranged at the bottom of the anchor ring 1, and an opening opposite to the through hole 1-1 is formed in the bearing plate 6.

The hot-melt anchor head also includes a strain gauge 7 connected with the guide wire 2 and arranged on the surface of the anchor ring 1. In this embodiment, the strain gauge 7 has a heat insulation property. For manufacturing the strain gauge 7 with the heat insulation property, the strain gauge 7 is coated by a heat-insulating film, or a heat-insulating coating is directly formed on the strain gauge 7, or the like. One, two or more strain gauges 7 can be adopted.

The anchor ring 1 is made of a metal material; a surface of the anchor ring 1 is integrally formed with a coating layer 8 by injection moulding with a hot-melt material, the whole anchor ring 1 is protected by the coating layer 8 against corrosion; the strain gauge 7 is coated by the coating layer 8 and is in close contact with the surface of the anchor ring 1 so as to be integrally formed; and an end, close to the bearing plate 6, of the anchor ring 1, extends inwards and is provided with a flange used for holding a part, located inside the through hole 1-1, of the coating layer 8.

When the hot-melt anchor head clamps the anchor cable reinforcement 4, the part, located inside the through hole 1-1, of the coating layer 8, fills a space between the anchor ring 1 and the clamp piece 5 and is limited in the space in all directions; and when the part, located inside the through hole 1-1, of the coating layer 8, is heated to be melted by the electrical hot-melt member 3, the hot-melt anchor head releases the anchor cable reinforcement 4.

The hot-melt anchor head is also provided with a measuring terminal (which is not shown in the drawings) used for measuring the length of the anchor cable reinforcement 4; the measuring terminal communicates with the outside through the guide wire 2 or through a wireless signal; the measuring terminal is fixed on the hot-melt anchor head and can be arranged on the outer side wall of the anchor ring 1 or any position of the bearing plate 6 or the hot-melt anchor head; and a set signal sent by the measuring terminal can be received by external equipment, so that the length of an anchor cable can be worked out.

In this embodiment, the strain gauge 7 is attached to the inner wall of the through hole 1-1 of the anchor ring 1, and a hole (which is not shown in the drawings) allowing the guide wire 2 to penetrate through is formed in the side wall of the anchor ring 1.

Figure 3:
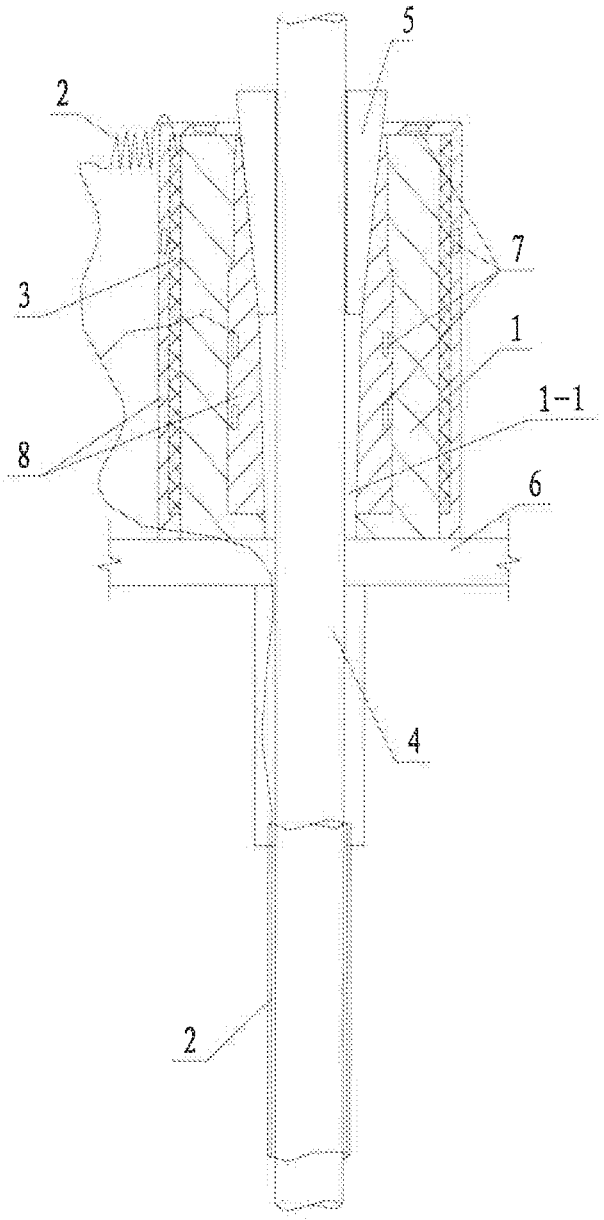
FIG. 3 is a structural view II of the hot-melt anchor head of the embodiment of the invention.

In this embodiment, the electrical hot-melt member 3 is arranged in the through hole 1-1 and is tightly coated by the part, located inside the through hole 1-1, of the coating layer 8 so as to be integrally formed, or as shown in FIG. 3, the electrical hot-melt member 3 is arranged on the outer side wall of the anchor ring 1 and is in close contact with the outer side wall of the anchor ring 1 and the part, located outside the through hole 1-1, of the coating layer 8 so as to be integrally formed; the part, located outside the through hole 1-1, of the coating layer 8 is used for protecting the anchor ring 1; the guide wire 2 stretches out of concrete or rock soil, the electrical hot-melt member 3 is a ring-shaped resistance wire, an S-shaped resistance wire, an electrical bar or a heating ring, and one or more clamp pieces 5 can be adopted, and the like.

The clamp piece 5 is arranged in the through hole 1-1 and clamps the anchor cable reinforcement 4 (a steel strand), the part, located inside the through hole 1-1, of the coating layer 8, fills the space between the anchor ring 1 and the clamp piece 5 and is limited in the space in all directions (the clamp piece 5 internally limits the part, located inside the through hole 1-1, of the coating layer 8, the bearing plate 6 externally limits the part, located inside the through hole 1-1, of the coating layer 8, the anchor ring 1 peripherally surrounds the part, located inside the through hole 1-1, of the coating layer 8, and in this way, the part, located inside the through hole 1-1, of the coating layer 8 is completely limited in all directions of the space); when the clamp piece 5 is inserted into the through hole 1-1, the part, located inside the through hole 1-1, of the coating layer 8 is effectively clamped in the through hole 1-1 by the anchor ring 1, the clamp piece 5 and the bearing plate 6, at this moment, the part, located inside the through hole 1-1, of the coating layer 8 is in a solid state, and a confining pressure effect can be formed on the part, located inside the through hole 1-1, of the coating layer 8, namely a pressed object has compressive strength improved by several times, dozens of times or even hundreds of times when limited in all directions in space without being deformed, and in this way, the clamp piece 5 is reversely pressed by the part, located inside the through hole 1-1, of the coating layer 8 to clamp the anchor cable reinforcement 4 so as to bear great drawing force, and existing supporting requirements can be completely met.

When a core material needs to be withdrawn, the guide wire 2 can be electrified to heat the electrical hot-melt member 3, and the part, located inside the through hole 1-1, of the coating layer 8 can be softened or melted and then flows out of the bearing plate 6 and the anchor ring 1, and in this way, the confining pressure effect on the part, located inside the through hole 1-1, of the coating layer 8 is relieved, and the frictional resistance between the core material and the clamp piece 5 is reduced or relieved, so that the purpose of conveniently withdrawing the core material is achieved.

During measurement, because the strain gauge 7 is coated by the coating layer 8 and is in close contact with the surface of the anchor ring 1 so as to be integrally formed, the steel strand, namely the internal force of an anchor stock, can be accurately monitored in real time.

In addition, the surface of the anchoring ring 1 is integrally formed with the coating layer 8 by injection moulding with a hot-melt material, and the strain gauge 7 is in close contact with the anchor ring 1 so as to be integrally formed and be firmly fixed, so that the hidden danger that the strain gauge 7 falls under complicated and changeable construction conditions and complicated and changeable transportation conditions is prevented during actual construction and transportation; and meanwhile, a complete protective layer is integrally formed by injection moulding on the whole surface of the metal anchor ring 1, so that the structure is simple, force measurement is accurate, and corrosion prevention of the whole anchor head, filling limitations required when clamping is conducted in the through hole 1-1 of the anchor head and filling hot-melting required when release is conducted in the through hole 1-1 of the anchor head are achieved at the same time.

The invention is not limited to the above embodiment, for example, (1) in this embodiment, the strain gauge 7 can be attached to the outer side wall of the anchor ring 1, the upper end surface of the anchor ring 1 or the lower end surface of the anchor ring 1; (2) the part, located inside the through hole 1-1, of the coating layer 8 has a conical surface matched with the clamp piece 5; (3) the hot-melt anchor head can be applied to the field of permanent anchors, an intelligent anchor stock is adopted to measure the internal force and the length of the anchor stock in real time, and the like. All technical schemes formed by dint of equivalent replacement should also fall within the protection scope of the invention.

What is claimed is:

1. A hot-melt anchor head, comprising an anchor ring, a guide wire, an electrical hot-melt member and a clamp piece, wherein the anchor ring is provided with at least one through hole; the guide wire can be electrified; the electrical hot-melt member is arranged on the anchor ring and connected with the guide wire; the clamp piece is arranged in the through hole to clamp an anchor cable reinforcement; a bearing plate is arranged at a bottom of the anchor ring, an opening opposite to the through hole is formed in the bearing plate, and the anchor ring is made of a metal material; the hot-melt anchor head further comprises a strain gauge connected with the guide wire and arranged on a surface of the anchor ring; the surface of the anchor ring is integrally formed with a coating layer by injection moulding with a hot-melt material, the strain gauge is coated by the coating layer and is in close contact with the surface of the anchor ring so as to be integrally formed, and an end, close to the bearing plate, of the anchor ring extends inwards and is provided with a flange, and the flange is used for holding a part, located inside the through hole, of the coating layer; when the hot-melt anchor head clamps the anchor cable reinforcement, the part, located inside the through hole, of the coating layer fills a space between the anchor ring and the clamp piece and is limited in the space in all directions; and when the part, located inside the through hole, of the coating layer is heated to be melted by the electrical hot-melt member, the hot-melt anchor head releases the anchor cable reinforcement.

2. The hot-melt anchor head according to claim 1, wherein the hot-melt anchor head is also provided with a measuring terminal used for measuring a length of the anchor cable reinforcement, and the measuring terminal communicates with the outside through the guide wire or through a wireless signal.

3. The hot-melt anchor head according to claim 2, wherein the strain gauge has a heat insulation property.

4. The hot-melt anchor head according to claim 3, wherein the strain gauge is attached to an inner wall of the through hole of the anchor ring, and a hole allowing the guide wire to penetrate through is formed in a side wall of the anchor ring.

5. The hot-melt anchor head according to claim 3, wherein the strain gauge is attached to an outer side wall of the anchor ring, an upper end surface of the anchor ring, or a lower end surface of the anchor ring.

6. The hot-melt anchor head according to claim 2, wherein the electrical hot-melt member is arranged in the through hole and is tightly wrapped by the part, located inside the through hole, of the coating layer so as to be integrally formed.

7. The hot-melt anchor head according to claim 2, wherein the electrical hot-melt member is arranged on an outer side wall of the anchor ring and is in close contact with the outer side wall of the anchor ring and a part, located outside the through hole, of the coating layer so as to be integrally formed.

8. The hot-melt anchor head according to claim 2, wherein the anchor ring is protected by a part, located outside the through hole, of the coating layer.

9. The hot-melt anchor head according to claim 2, wherein the part, located inside the through hole, of the coating layer has a conical surface which is matched with the clamp piece.

10. The hot-melt anchor head according to claim 1, wherein the strain gauge has a heat insulation property.

11. The hot-melt anchor head according to claim 10, wherein the strain gauge is attached to an inner wall of the through hole of the anchor ring, and a hole allowing the guide wire to penetrate through is formed in a side wall of the anchor ring.

12. The hot-melt anchor head according to claim 10, wherein the strain gauge is attached to an outer side wall of the anchor ring, an upper end surface of the anchor ring, or a lower end surface of the anchor ring.

13. The hot-melt anchor head according to claim 1, wherein the electrical hot-melt member is arranged in the through hole and is tightly wrapped by the part, located inside the through hole, of the coating layer so as to be integrally formed.

14. The hot-melt anchor head according to claim 1, wherein the electrical hot-melt member is arranged on an outer side wall of the anchor ring and is in close contact with the outer side wall of the anchor ring and a part, located outside the through hole, of the coating layer so as to be integrally formed.

15. The hot-melt anchor head according to claim 1, wherein the anchor ring is protected by a part, located outside the through hole, of the coating layer.

16. The hot-melt anchor head according to claim 1, wherein the part, located inside the through hole, of the coating layer has a conical surface which is matched with the clamp piece.

* * * * *